US005524855A

United States Patent [19]

Lesar

[11] Patent Number: 5,524,855

[45] Date of Patent: Jun. 11, 1996

[54] UMBRELLA POST SAND ANCHOR

[76] Inventor: Dean A. Lesar, 2800 Keller Dr., #65, Tustin, Calif. 92680

[21] Appl. No.: 347,677

[22] Filed: Dec. 1, 1994

[51] Int. Cl.[6] ..... F16M 13/00

[52] U.S. Cl. ..... 248/530; 248/156; 135/16; 405/244

[58] Field of Search ..... 405/244; 52/157; 248/530, 156; 135/16

[56] References Cited

U.S. PATENT DOCUMENTS 3,066,769 5/1960 Pasquale ..... 248/530 X 4,257,181 3/1981 Cooper ..... 248/530 X 4,334,661 6/1982 Pitt ..... 248/156 X

*Primary Examiner*—Ramon S. Britts

*Assistant Examiner*—Frederick L. Lagman

[57] ABSTRACT

An anchor for supporting an umbrella post in a vertical position relative to a ground surface. The inventive device includes a cylindrical main body positionable into the ground surface and having a cylindrical bore for receiving the umbrella post. The cylindrical body includes a shovel formed at a lower end thereof, and a storage cup secured to an upper end for receiving and storing small articles or the like.

6 Claims, 4 Drawing Sheets

FIG 1
PRIOR ART
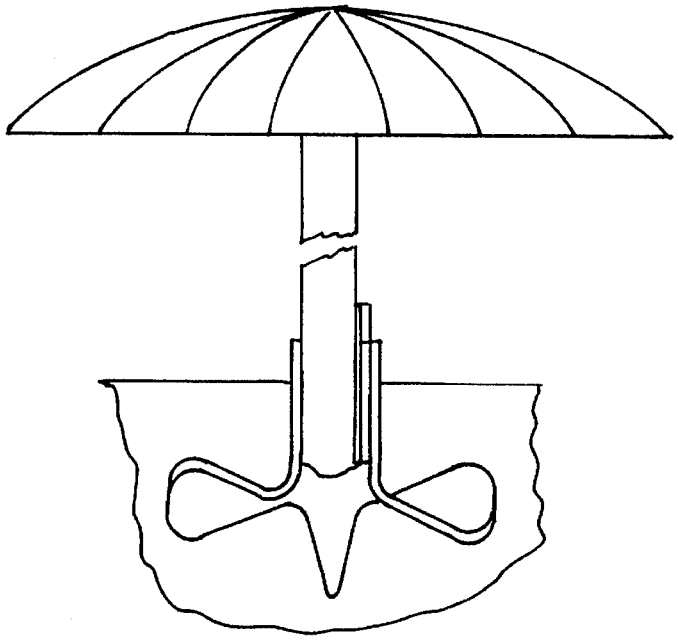
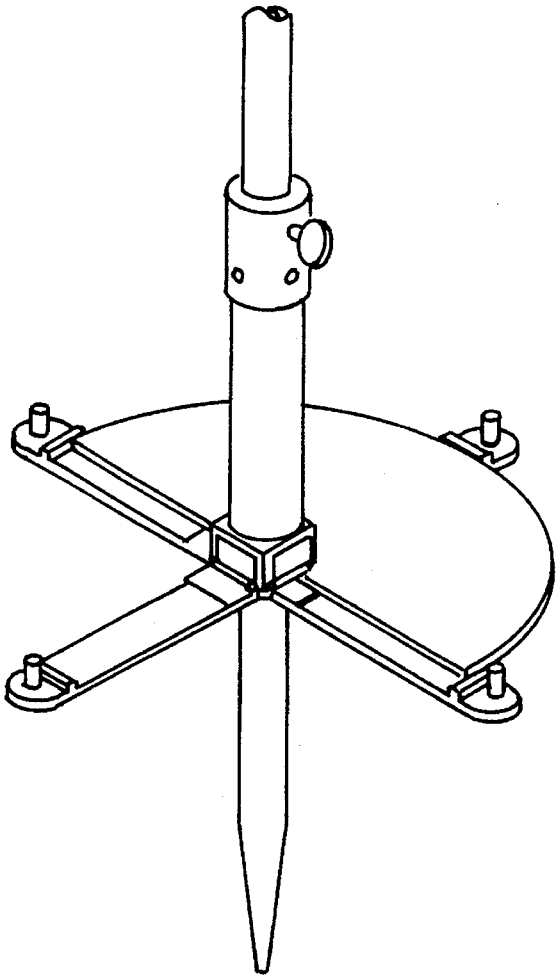
FIG 2
PRIOR ART

UMBRELLA POST SAND ANCHOR

BACKGROUND OF THE INVENTION

1. Field of the Invention

The present invention relates to supporting devices and more particularly pertains to an umbrella post sand anchor for supporting an umbrella post in a vertical position relative to a ground surface.

2. Description of the Prior Art

The use of supporting devices is known in the prior art. More specifically, supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art supporting devices include U.S. Pat. No. 5,199,361; U.S. Pat. No. 5,156,369; U.S. Pat. No. 5,122,014; U.S. Pat. No. 4,924,893; U.S. Pat. No. 4,753,411; and U.S. Pat. No. 4,296,693.

While these devices fulfill their respective, particular objectives and requirements, the aforementioned patents do not disclose an umbrella post sand anchor for supporting an umbrella post in a vertical position which includes a cylindrical main body positionable into a ground surface and having a cylindrical bore for receiving the umbrella post, wherein the cylindrical body includes a shovel formed at a lower end thereof and a storage cup secured at an upper end for receiving and storing small articles.

In these respects, the umbrella post sand anchor according to the present invention substantially departs from the conventional concepts and designs of the prior art, and in so doing provides an apparatus primarily developed for the purpose of supporting an umbrella post in a vertical position relative to a ground surface.

SUMMARY OF THE INVENTION

In view of the foregoing disadvantages inherent in the known types of supporting devices now present in the prior art, the present invention provides a new umbrella post sand anchor construction wherein the same can be utilized for supporting an umbrella post in a vertical position relative to a ground surface. As such, the general purpose of the present invention, which will be described subsequently in greater detail, is to provide a new umbrella post sand anchor apparatus and method which has many of the advantages of the supporting devices mentioned heretofore and many novel features that result in an umbrella post sand anchor which is not anticipated, rendered obvious, suggested, or even implied by any of the prior art supporting devices, either alone or in any combination thereof.

To attain this, the present invention generally comprises an anchor for supporting an umbrella post in a vertical position relative to a ground surface. The inventive device includes a cylindrical main body positionable into the ground surface and having a cylindrical bore for receiving the umbrella post. The cylindrical body includes a shovel formed at a lower end thereof, and a storage cup secured to an upper end for receiving and storing small articles or the like.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new umbrella post sand anchor apparatus and method which has many of the advantages of the supporting devices mentioned heretofore and many novel features that result in an umbrella post sand anchor which is not anticipated, rendered obvious, suggested, or even implied by any of the prior art supporting devices, either alone or in any combination thereof.

It is another object of the present invention to provide a new umbrella post sand anchor which may be easily and efficiently manufactured and marketed.

It is a further object of the present invention to provide a new umbrella post sand anchor which is of a durable and reliable construction.

An even further object of the present invention is to provide a new umbrella post sand anchor which is susceptible of a low cost of manufacture with regard to both materials and labor, and which accordingly is then susceptible of low prices of sale to the consuming public, thereby making such umbrella post sand anchors economically available to the buying public.

Still yet another object of the present invention is to provide a new umbrella post sand anchor which provides in the apparatuses and methods of the prior art some of the advantages thereof, while simultaneously overcoming some of the disadvantages normally associated therewith.

Still another object of the present invention is to provide a new umbrella post sand anchor for supporting an umbrella post in a vertical position relative to a ground surface, such as a sandy beach surface.

Yet another object of the present invention is to provide a new umbrella post sand anchor which includes a cylindrical main body positionable into a ground surface and having a cylindrical bore for receiving the umbrella post, wherein the cylindrical body includes a shovel formed at a lower end thereof and a storage cup secured at an upper end for receiving and storing small articles or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevation view of a prior art supporting device.

FIG. 2 is an isometric illustration of a further prior art supporting device.

DESCRIPTION OF THE PREFERRED EMBODIMENT

Figure 3:
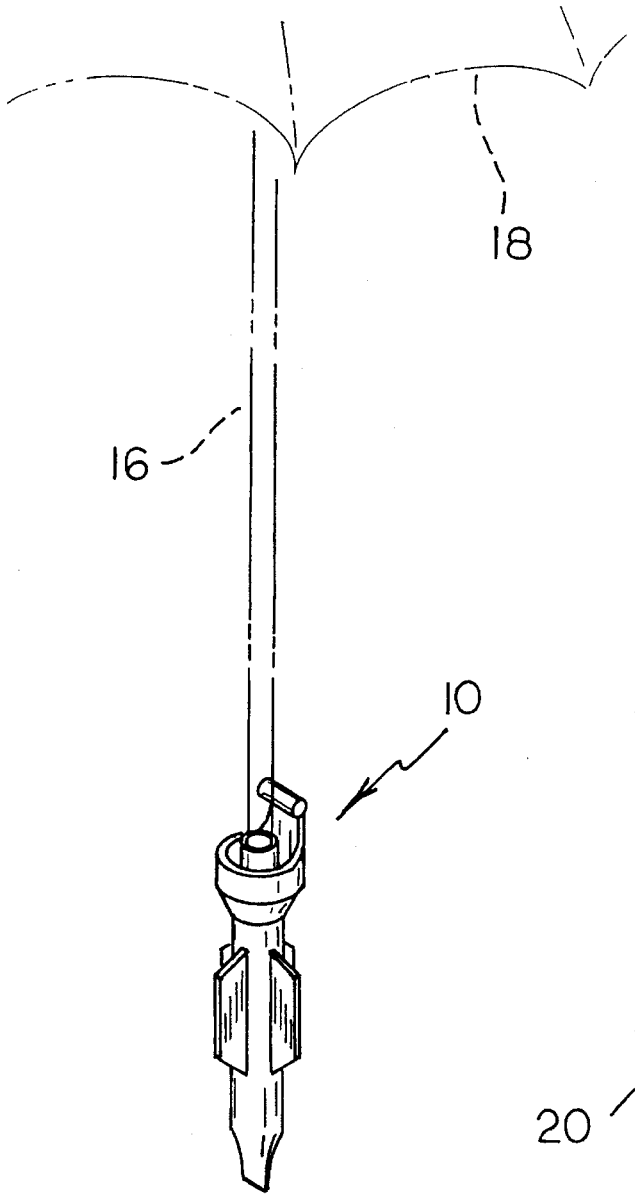
FIG. 3 is an isometric illustration of an umbrella post sand anchor according to the present invention in use.
Figure 4:
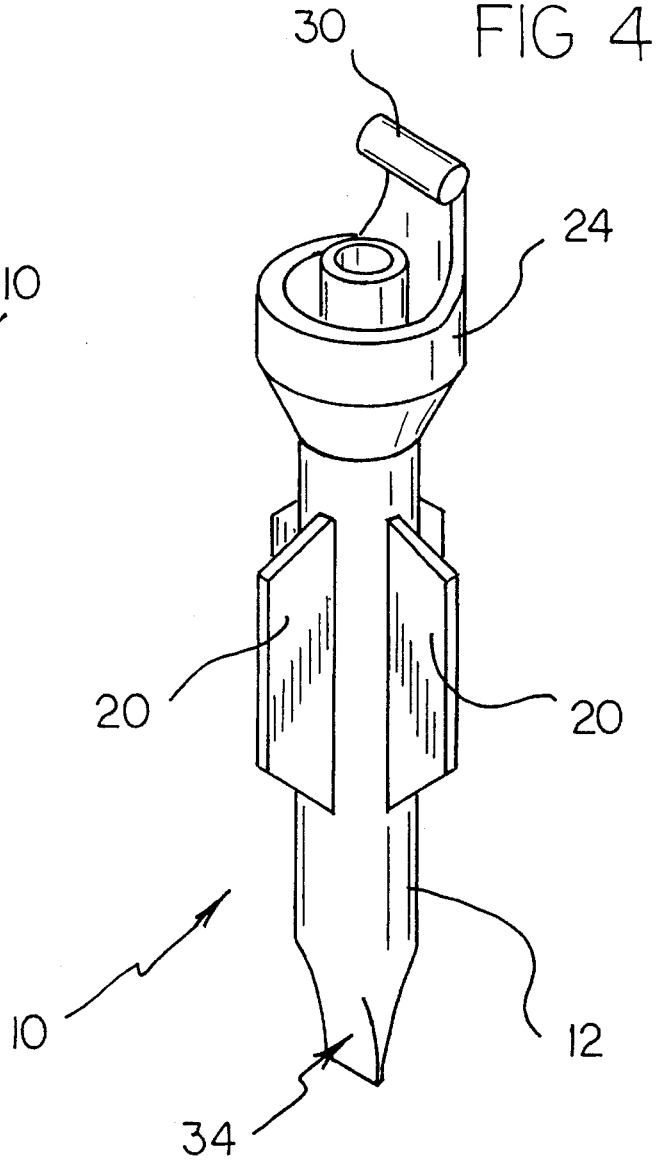
FIG. 4 is an isometric illustration of the invention, per se.

With reference now to the drawings, and in particular to FIGS. 3–8 thereof, a new umbrella post sand anchor embodying the principles and concepts of the present invention and generally designated by the reference numeral 10 will be described.

More specifically, it will be noted that the umbrella post sand anchor 10 comprises a substantially cylindrical main body 12 of elongated configurations suitable for placement into a ground surface. The cylindrical main body 12 is shaped so as to define a cylindrical bore 14 (see FIG. 7) extending longitudinally thereinto operable to receive an umbrella post 16 of an umbrella 18 to be supported, as illustrated in FIG. 3. A plurality of stabilizing webs 20 project substantially orthogonally from an exterior surface of the cylindrical main body 12 and are radially spaced about a circumference thereof. The stabilizing webs 20 serve to engage the ground surface to preclude a rotational movement of the device 10 relative to the ground surface when so installed. By this structure, the cylindrical main body 12 can be inserted into a ground surface, with the umbrella post 16 being subsequently positioned into the cylindrical bore 14 to support the umbrella 18 in a vertical orientation relative to the underlying ground surface.

Figure 5:
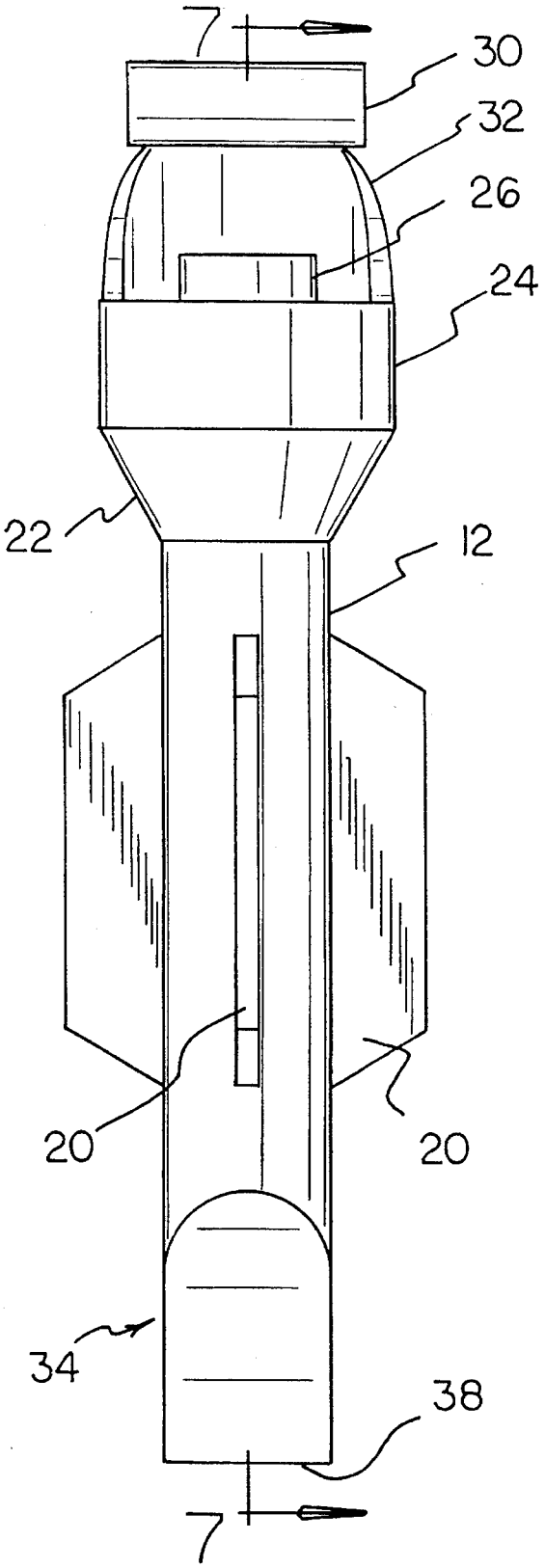
FIG. 5 is a front elevation view thereof.
Figure 6:
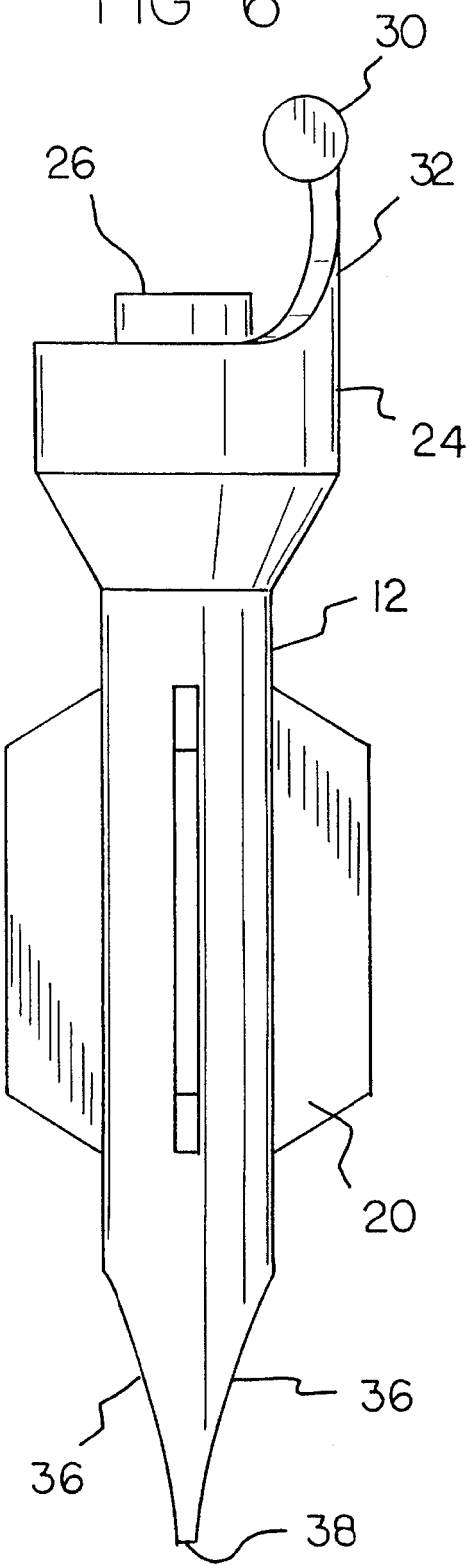
FIG. 6 is a side elevation view of the present invention.
Figure 7:
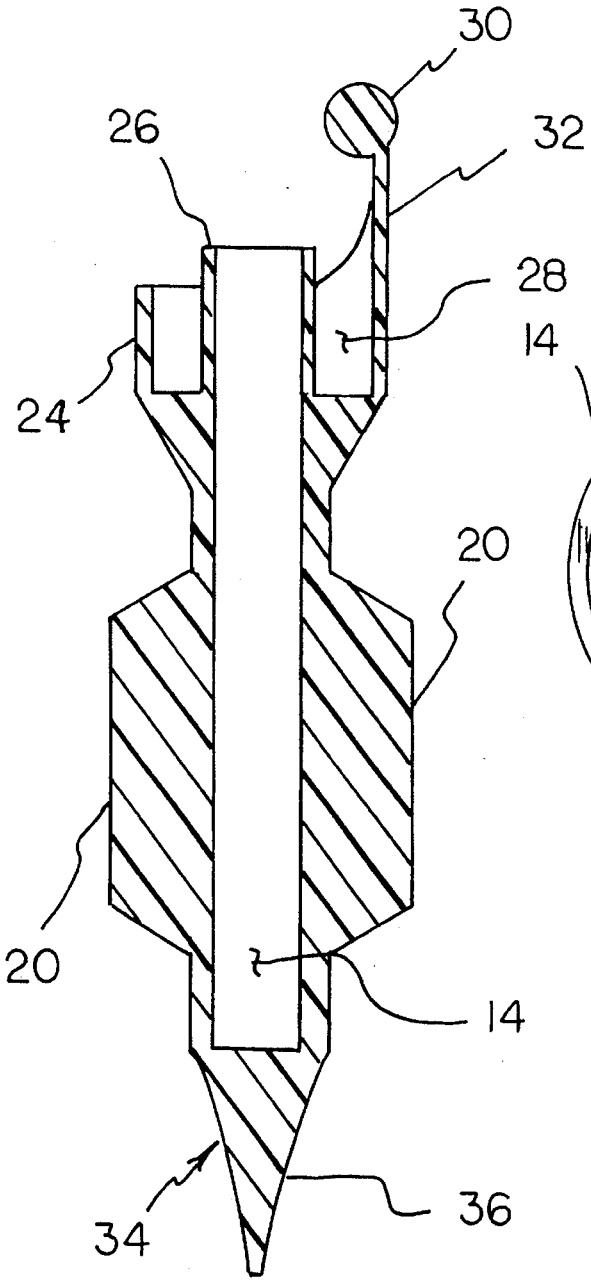
FIG. 7 is a cross-sectional view taken along lines 7—7 of FIG. 5.
Figure 8:
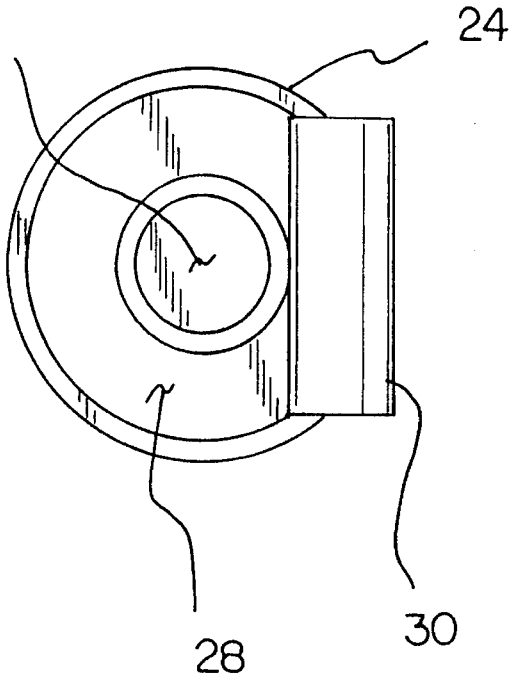
FIG. 8 is a top plan view of the invention.

As best illustrated in FIGS. 5 and 6, the cylindrical main body 12 is shaped so as to define a tapered neck 22 extending upwardly from a top end thereof which continues into a cylindrical storage cup 24. As shown in FIGS. 7 and 8, the storage cup 24 is substantially hollow so as to receive small objects, such as rings or jewelry therewithin. To preclude an unintentional placement of the small objects into the cylindrical bore 14 when the umbrella post 16 is absent therefrom, a center guide tube 26 is concentrically positioned within the storage cup 14 in contiguous communication with the cylindrical bore 14 such that the umbrella post 16 projects through the center guide tubes 26 and into the cylindrical bore 14. Thus, the storage cup 24 in combination with the center guide tube 26 defines an annular storage compartment 28 operable to receive such small objects. Preferably, the storage cup 24, the tapered neck 22, and the cylindrical main body 12 are integrally formed of a plastic material or the like, with the cylindrical main body having a first diameter and the storage cup having a second diameter, wherein the second diameter is substantially greater than the first diameter so as to define the annular storage compartment 28. Further, it is contemplated that the stabilizing webs 20 could also be integrally molded into the device 10.

To facilitate manual manipulation of the device 10 during installation and/or removal thereof, a cylindrical handle 30 is coupled to an upper perimeter of the storage cup 24 by a semi-cylindrical handle mount 32. The semi-cylindrical handle mount 32 and the cylindrical handle 30 can also be integrally molded into the storage cup 24 substantially as shown. Preferably, the handle 30 is symmetrically oriented about a longitudinal axis and positioned such that the longitudinal axis thereof extends substantially parallel to a tangent of the cylindrical main body 12.

During installation of the device 10 into the ground surface, the cylindrical main body 12 can simply be thrust into the ground surface, thereby piercing and subsequently engaging the ground surface in a secure manner. Alternatively, a small hole may be excavated and the device 10 then positioned thereinto and subsequently back filled during setup of the apparatus. To facilitate excavation of such a small hole, a shovel means 34 is formed into a lower end of the cylindrical main body 12 for facilitating a manual excavation of a desired volume of the ground surface. As shown in FIGS. 5 and 6, the shovel means 34 of the present invention 10 is defined by a pair of opposed arcuate surfaces 36 integrally formed into the cylindrical main body 12 which taper the cylindrical main body to an elongated straight piercing blade 38. Preferably, the elongated piercing blade 38 is oriented so as to extend substantially parallel to the longitudinal axis of the handle 30 such that either of the opposed arcuate surfaces 36 can be utilized to extend beneath a portion of the ground surface and subsequently excavate such portion.

In use, the present invention 10 can be utilized to excavate or dig a small hole into the ground surface of a beach or the like through a manual manipulation of the shovel means 34 as described above. The cylindrical main body 12 can then be positioned into the small hole formed in the ground surface, with the excavated material then being utilized to back fill the device to secure it into the ground surface. The post 16 of an associated umbrella 18 can then be inserted through the center guide tube 26 and into the cylindrical bore 14 to support the umbrella 18 in a substantially perpendicular orientation relative to the ground surface. Small objects, such as rings or other jewelry can then be positioned within the annular storage compartment 28 to preclude a loss thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A umbrella post sand anchor comprising:

an elongated cylindrical main body having a cylindrical bore extending longitudinally thereinto operable to receive an umbrella post of an umbrella to be supported wherein, the cylindrical main body is shaped so as to define a tapered neck extending upwardly from a top end thereof which continues into a cylindrical storage cup, the storage cup being substantially hollow so as to receive small objects, the main body being further shaped so as to define a center guide tube concentrically positioned within the storage cup in contiguous communication with the cylindrical bore, wherein the storage cup in combination with the center guide tube defines an annular storage compartment; and, a plurality of radially spaced stabilizing webs projecting substantially orthogonally from an exterior surface of said cylindrical main body.

2. The umbrella post sand anchor of claim 1, and further comprising a semi-cylindrical handle mount coupled to an upper perimeter of the storage cup; and a cylindrical handle mounted to the semi-cylindrical handle mount.

3. The umbrella post sand anchor of claim 2, wherein the handle is symmetrically oriented about a longitudinal axis and positioned such that the longitudinal axis thereof extends substantially parallel to a tangent of the cylindrical main body.

4. The umbrella post sand anchor of claim 3, and further comprising a shovel means for facilitating a manual excavation of a volume of the ground surface into which the cylindrical main body is to be inserted, the shovel means being formed into a lower end of the cylindrical main body.

5. The umbrella post sand anchor of claim 4, wherein the shovel means is defined by a pair of opposed arcuate surfaces integrally formed into the cylindrical main body which taper the cylindrical main body to an elongated straight piercing blade.

6. The umbrella post sand anchor of claim 5, wherein the elongated piercing blade is oriented so as to extend substantially parallel to the longitudinal axis of the handle such that either of the opposed arcuate surfaces can be utilized to extend beneath a portion of a ground surface.

* * * * *